US006932687B2

(12) United States Patent
Agarwal et al.

(10) Patent No.: US 6,932,687 B2
(45) Date of Patent: Aug. 23, 2005

(54) PLANARIZING PADS FOR PLANARIZATION OF MICROELECTRONIC SUBSTRATES

(75) Inventors: Vishnu K. Agarwal, Boise, ID (US); Dinesh Chopra, Boise, ID (US)

(73) Assignee: Micron Technology, Inc., Boise, ID (US)

( * ) Notice: Subject to any disclaimer, the term of this patent is extended or adjusted under 35 U.S.C. 154(b) by 0 days.

(21) Appl. No.: 10/772,540

(22) Filed: Feb. 5, 2004

(65) Prior Publication Data

US 2004/0166792 A1 Aug. 26, 2004

Related U.S. Application Data

(62) Division of application No. 09/649,429, filed on Aug. 18, 2000, now Pat. No. 6,736,869.

(51) Int. Cl.[7] ..... B24B 1/00

(52) U.S. Cl. ..... 451/548; 451/41; 451/285; 51/298

(58) Field of Search ..... 451/285–290, 451/548, 41; 51/298, 293, 295, 297, 307–309

(56) References Cited

U.S. PATENT DOCUMENTS

| | | | |
|---|---|---|---|
| 5,020,283 | A | 6/1991 | Tuttle |
| 5,177,908 | A | 1/1993 | Tuttle |
| 5,196,353 | A | 3/1993 | Sandhu et al. |
| 5,222,329 | A | 6/1993 | Yu |
| 5,232,875 | A | 8/1993 | Tuttle et al. |
| 5,234,867 | A | 8/1993 | Schultz et al. |
| 5,240,552 | A | 8/1993 | Yu et al. |
| 5,244,534 | A | 9/1993 | Yu et al. |
| 5,297,364 | A | 3/1994 | Tuttle |
| 5,314,843 | A | 5/1994 | Yu et al. |

(Continued)

OTHER PUBLICATIONS

U.S. Appl. No. 09/649,429, filed Aug. 28, 2000, Agarwal et al.

U.S. Appl. No. 09/649,427, filed Aug. 28, 2000, Meikle.

U.S. Appl. No. 10/662,901, filed Sep. 15, 2003, Meikle.

Kondo, S. et al., "Abrasive–Free Polishing for Copper Damascene Interconnection", *Journal of the Electrochemical Society,* 147 (10) 3907–3913 (2000).

* cited by examiner

*Primary Examiner*—Lee D. Wilson
*Assistant Examiner*—Anthony Ojini
(74) *Attorney, Agent, or Firm*—Perkins Coie LLP

(57) ABSTRACT

A planarizing pad for planarizing a microelectronic substrate, and a method and apparatus for forming the planarizing pad. In one embodiment, planarizing pad material is mixed with compressed gas to form a plurality of discrete elements that are distributed on a support material. At least a portion of the discrete elements are spaced apart from each other on the support material to form a textured surface for engaging a microelectronic substrate and removing material from the microelectronic substrate. The discrete elements can be uniformly or randomly distributed on the support material, and the discrete elements can be directly affixed to the support material or affixed to the support material with an adhesive.

20 Claims, 7 Drawing Sheets

U.S. PATENT DOCUMENTS

| | | | | | |
|---|---|---|---|---|---|
| 5,421,769 | A | | 6/1995 | Schultz et al. | |
| 5,449,314 | A | | 9/1995 | Meikle et al. | |
| 5,486,129 | A | | 1/1996 | Sandhu et al. | |
| 5,514,245 | A | | 5/1996 | Doan et al. | |
| 5,540,810 | A | | 7/1996 | Sandhu et al. | |
| 5,609,718 | A | | 3/1997 | Meikle | |
| 5,616,069 | A | | 4/1997 | Walker et al. | |
| 5,618,381 | A | | 4/1997 | Doan et al. | |
| 5,624,303 | A | | 4/1997 | Robinson | |
| 5,643,048 | A | | 7/1997 | Iyer | |
| 5,645,682 | A | | 7/1997 | Skrovan | |
| 5,650,619 | A | | 7/1997 | Hudson | |
| 5,655,951 | A | | 8/1997 | Meikle et al. | |
| 5,658,190 | A | | 8/1997 | Wright et al. | |
| 5,663,797 | A | | 9/1997 | Sandhu | |
| 5,679,065 | A | | 10/1997 | Henderson | |
| 5,690,540 | A | | 11/1997 | Elliott et al. | |
| 5,690,705 | A | | 11/1997 | Holmes et al. | |
| 5,698,455 | A | | 12/1997 | Meikle et al. | |
| 5,702,292 | A | | 12/1997 | Brunelli et al. | |
| 5,725,417 | A | | 3/1998 | Robinson | |
| 5,725,420 | A | | 3/1998 | Torii | |
| 5,733,176 | A | | 3/1998 | Robinson et al. | |
| 5,736,427 | A | | 4/1998 | Henderson | |
| 5,738,567 | A | | 4/1998 | Manzonie et al. | |
| 5,747,386 | A | | 5/1998 | Moore | |
| 5,779,522 | A | | 7/1998 | Walker et al. | |
| 5,782,675 | A | | 7/1998 | Southwick | |
| 5,782,682 | A | * | 7/1998 | Han et al. | 451/548 |
| 5,791,969 | A | | 8/1998 | Lund | |
| 5,792,709 | A | | 8/1998 | Robinson et al. | |
| 5,795,218 | A | | 8/1998 | Doan et al. | |
| 5,795,495 | A | | 8/1998 | Meikle | |
| 5,798,302 | A | | 8/1998 | Hudson et al. | |
| 5,801,066 | A | | 9/1998 | Meikle | |
| 5,823,855 | A | | 10/1998 | Robinson | |
| 5,830,806 | A | | 11/1998 | Hudson et al. | |
| 5,846,336 | A | | 12/1998 | Skrovan | |
| 5,855,804 | A | | 1/1999 | Walker | |
| 5,868,896 | A | | 2/1999 | Robinson et al. | |
| 5,871,392 | A | | 2/1999 | Meikle et al. | |
| 5,879,222 | A | | 3/1999 | Robinson | |
| 5,879,226 | A | | 3/1999 | Robinson | |
| 5,882,248 | A | | 3/1999 | Wright et al. | |
| 5,893,754 | A | | 4/1999 | Robinson et al. | |
| 5,894,852 | A | | 4/1999 | Gonzales et al. | |
| 5,910,043 | A | | 6/1999 | Manzonie et al. | |
| 5,910,846 | A | | 6/1999 | Sandhu | |
| 5,919,082 | A | | 7/1999 | Walker et al. | |
| 5,930,699 | A | | 7/1999 | Bhatia | |
| 5,934,980 | A | | 8/1999 | Koos et al. | |
| 5,938,801 | A | | 8/1999 | Robinson | |
| 5,942,015 | A | | 8/1999 | Culler et al. | |
| 5,945,347 | A | | 8/1999 | Wright | |
| 5,954,912 | A | | 9/1999 | Moore | |
| 5,967,030 | A | | 10/1999 | Blalock | |
| 5,972,792 | A | | 10/1999 | Hudson | |
| 5,976,000 | A | | 11/1999 | Hudson | |
| 5,980,363 | A | | 11/1999 | Meikle et al. | |
| 5,981,396 | A | | 11/1999 | Robinson et al. | |
| 5,989,470 | A | | 11/1999 | Doan et al. | |
| 5,990,012 | A | | 11/1999 | Robinson et al. | |
| 5,994,224 | A | | 11/1999 | Sandhu et al. | |
| 5,997,384 | A | | 12/1999 | Blalock | |
| 6,036,586 | A | | 3/2000 | Ward | |
| 6,039,633 | A | | 3/2000 | Chopra | |
| 6,040,245 | A | | 3/2000 | Sandhu et al. | |
| 6,046,111 | A | | 4/2000 | Robinson | |
| 6,054,015 | A | | 4/2000 | Brunelli et al. | |
| 6,057,602 | A | | 5/2000 | Hudson et al. | |
| 6,062,958 | A | | 5/2000 | Wright et al. | |
| 6,083,085 | A | | 7/2000 | Lankford | |
| 6,090,475 | A | | 7/2000 | Robinson et al. | |
| 6,106,351 | A | | 8/2000 | Raina et al. | |
| 6,108,092 | A | | 8/2000 | Sandhu | |
| 6,110,015 | A | * | 8/2000 | Christianson et al. | 451/41 |
| 6,110,820 | A | | 8/2000 | Sandhu et al. | |
| 6,114,706 | A | | 9/2000 | Meikle et al. | |
| 6,120,354 | A | | 9/2000 | Koos et al. | |
| 6,124,207 | A | | 9/2000 | Robinson et al. | |
| 6,135,856 | A | | 10/2000 | Tjaden et al. | |
| 6,136,043 | A | | 10/2000 | Robinson et al. | |
| 6,139,402 | A | | 10/2000 | Moore | |
| 6,143,123 | A | | 11/2000 | Robinson et al. | |
| 6,176,763 | B1 | | 1/2001 | Kramer et al. | |
| 6,186,870 | B1 | | 2/2001 | Wright et al. | |
| 6,187,681 | B1 | | 2/2001 | Moore | |
| 6,190,494 | B1 | | 2/2001 | Dow | |
| 6,191,037 | B1 | | 2/2001 | Robinson et al. | |
| 6,191,864 | B1 | | 2/2001 | Sandhu | |
| 6,196,899 | B1 | | 3/2001 | Chopra et al. | |
| 6,200,901 | B1 | | 3/2001 | Hudson et al. | |
| 6,203,407 | B1 | | 3/2001 | Robinson | |
| 6,203,413 | B1 | | 3/2001 | Skrovan | |
| 6,206,754 | B1 | | 3/2001 | Moore | |
| 6,206,756 | B1 | | 3/2001 | Chopra et al. | |
| 6,206,759 | B1 | | 3/2001 | Agarwal et al. | |
| 6,206,769 | B1 | | 3/2001 | Walker | |
| 6,210,257 | B1 | | 4/2001 | Carlson | |
| 6,213,845 | B1 | | 4/2001 | Elledge | |
| 6,220,934 | B1 | | 4/2001 | Sharples et al. | |
| 6,227,955 | B1 | | 5/2001 | Custer et al. | |
| 6,234,877 | B1 | | 5/2001 | Koos et al. | |
| 6,234,878 | B1 | | 5/2001 | Moore | |
| 6,237,483 | B1 | | 5/2001 | Blalock | |
| 6,238,270 | B1 | | 5/2001 | Robinson | |
| 6,238,273 | B1 | | 5/2001 | Southwick | |
| 6,244,944 | B1 | | 6/2001 | Elledge | |
| 6,250,994 | B1 | | 6/2001 | Chopra et al. | |
| 6,251,785 | B1 | | 6/2001 | Wright | |
| 6,254,460 | B1 | | 7/2001 | Walker et al. | |
| 6,261,163 | B1 | | 7/2001 | Walker et al. | |
| 6,267,650 | B1 | | 7/2001 | Hembree | |
| 6,271,139 | B1 | | 8/2001 | Alwan et al. | |
| 6,273,101 | B1 | | 8/2001 | Gonzales et al. | |
| 6,273,786 | B1 | | 8/2001 | Chopra et al. | |
| 6,273,796 | B1 | | 8/2001 | Moore | |
| 6,273,800 | B1 | | 8/2001 | Walker et al. | |
| 6,276,996 | B1 | | 8/2001 | Chopra | |
| 6,277,015 | B1 | | 8/2001 | Robinson et al. | |
| 6,284,660 | B1 | | 9/2001 | Doan | |
| 6,287,879 | B1 | | 9/2001 | Gonzales et al. | |
| 6,290,572 | B1 | | 9/2001 | Hofmann | |
| 6,290,579 | B1 | | 9/2001 | Walker et al. | |
| 6,296,557 | B1 | | 10/2001 | Walker | |
| 6,301,006 | B1 | | 10/2001 | Doan | |
| 6,306,008 | B1 | | 10/2001 | Moore | |
| 6,306,012 | B1 | | 10/2001 | Sabde | |
| 6,306,014 | B1 | | 10/2001 | Walker et al. | |
| 6,309,282 | B1 | | 10/2001 | Wright et al. | |
| 6,312,558 | B2 | | 11/2001 | Moore | |
| 6,313,038 | B1 | | 11/2001 | Chopra et al. | |
| 6,319,108 | B1 | | 11/2001 | Adefris et al. | |
| 6,319,420 | B1 | | 11/2001 | Dow | |
| 6,323,046 | B1 | | 11/2001 | Agarwal | |
| 6,325,702 | B2 | | 12/2001 | Robinson | |
| 6,328,632 | B1 | | 12/2001 | Chopra | |
| 6,331,135 | B1 | | 12/2001 | Sabde et al. | |
| 6,331,139 | B2 | | 12/2001 | Walker et al. | |
| 6,331,488 | B1 | | 12/2001 | Doan et al. | |
| 6,332,832 | B1 | * | 12/2001 | Suzuki | 451/41 |

6,350,180 B2 2/2002 Southwick
6,350,691 B1 2/2002 Lankford
6,352,466 B1 3/2002 Moore
6,352,470 B2 3/2002 Elledge
6,354,919 B2 3/2002 Chopra
6,354,929 B1 3/2002 Adefris et al.
6,354,930 B1 3/2002 Moore
6,358,122 B1 3/2002 Sabde et al.
6,361,400 B2 3/2002 Southwick
6,361,417 B2 3/2002 Walker et al.
6,361,832 B1 3/2002 Agarwal et al.
6,364,749 B1 4/2002 Walker
6,364,757 B2 4/2002 Moore
6,409,586 B2 6/2002 Walker et al.
6,413,153 B1 7/2002 Molar
6,579,799 B2 6/2003 Chopra et al.

PLANARIZING PADS FOR PLANARIZATION OF MICROELECTRONIC SUBSTRATES

This application is a divisional application of U.S. patent application Ser. No. 09/649,429, entitled "METHOD FOR FORMING A PLANARIZING PAD FOR PLANARIZATION OF MICROELECTRONIC SUBSTRATES," filed Aug. 28, 2000, now U.S. Pat. No. 6,736,869, issued May 18, 2004; and is related to U.S. patent application Ser. No. 10/772,541 entitled "APPARATUSES FOR FORMING A PLANARIZING PAD FOR PLANARIZATION OF MICROELECTRONIC SUBSTRATES," filed Feb. 5, 2004, which is a divisional application of U.S. patent application Ser. No. 09/649,429, both of which are herein incorporated by reference in their entireties.

TECHNICAL FIELD

This invention relates to planarizing pads and methods and apparatuses for forming planarizing pads for planarizing microelectronic substrates.

BACKGROUND OF THE INVENTION

Mechanical and chemical-mechanical planarization processes (collectively "CMP") are used in the manufacturing of electronic devices for forming a flat surface on semiconductor wafers, field emission displays and many other microelectronic-device substrate assemblies. CMP processes generally remove material from a substrate assembly to create a highly planar surface at a precise elevation in the layers of material on the substrate assembly. FIG. 1 schematically illustrates an existing web-format planarizing machine 10 for planarizing a substrate 12. The planarizing machine 10 has a support table 14 with a top-panel 16 at a workstation where an operative portion "A" of a planarizing pad 40 is positioned. The top-panel 16 is generally a rigid plate to provide a flat, solid surface to which a particular section of the planarizing pad 40 may be secured during planarization.

The planarizing machine 10 also has a plurality of rollers to guide, position and hold the planarizing pad 40 over the top-panel 16. The rollers include a supply roller 20, idler rollers 21, guide rollers 22, and a take-up roller 23. The supply roller 20 carries an unused or pre-operative portion of the planarizing pad 40, and the take-up roller 23 carries a used or post-operative portion of the planarizing pad 40. Additionally, the left idler roller 21 and the upper guide roller 22 stretch the planarizing pad 40 over the top-panel 16 to hold the planarizing pad 40 stationary during operation. A motor (not shown) drives at least one of the supply roller 20 and the take-up roller 23 to sequentially advance the planarizing pad 40 across the top-panel 16. Accordingly, clean pre-operative sections of the planarizing pad 40 may be quickly substituted for used sections to provide a consistent surface for planarizing and/or cleaning the substrate 12.

The web-format planarizing machine 10 also has a carrier assembly 30 that controls and protects the substrate 12 during planarization. The carrier assembly 30 generally has a substrate holder 32 to pick up, hold and release the substrate 12 at appropriate stages of the planarizing process. Several nozzles 33 attached to the substrate holder 32 dispense a planarizing solution 44 onto a planarizing surface 42 of the planarizing pad 40. The carrier assembly 30 also generally has a support gantry 34 carrying a drive assembly 35 that can translate along the gantry 34. The drive assembly 35 generally has an actuator 36, a drive shaft 37 coupled to the actuator 36, and an arm 38 projecting from the drive shaft 37. The arm 38 carries the substrate holder 32 via a terminal shaft 39 such that the drive assembly 35 orbits the substrate holder 32 about an axis B—B (as indicated by arrow "$R_1$"). The terminal shaft 39 may also rotate the substrate holder 32 about its central axis C—C (as indicated by arrow "$R_2$").

The planarizing pad 40 and the planarizing solution 44 define a planarizing medium that mechanically and/or chemically-mechanically removes material from the surface of the substrate 12. The planarizing pad 40 used in the web-format planarizing machine 10 is typically a fixed-abrasive planarizing pad in which abrasive particles are fixedly bonded to a suspension material. In fixed-abrasive applications, the planarizing solution is a "clean solution" without abrasive particles. In other applications, the planarizing pad 40 may be a non-abrasive pad without abrasive particles. The planarizing solutions 44 used with the non-abrasive planarizing pads are typically CMP slurries with abrasive particles and chemicals.

To planarize the substrate 12 with the planarizing machine 10, the carrier assembly 30 presses the substrate 12 against the planarizing surface 42 of the planarizing pad 40 in the presence of the planarizing solution 44. The drive assembly 35 then orbits the substrate holder 32 about the axis B—B, and optionally rotates the substrate holder 32 about the axis C—C, to translate the substrate 12 across the planarizing surface 42. As a result, the abrasive particles and/or the chemicals in the planarizing medium remove material from the surface of the substrate 12.

The CMP processes should consistently and accurately produce a uniformly planar surface on the substrate 12 to enable precise fabrication of circuits and photopatterns. During the fabrication of transistors, contacts, interconnects and other features, many substrates and/or substrate assemblies develop large "step heights" that create a highly topographic surface across the substrate assembly. Yet, as the density of integrated circuits increases, it is necessary to have a planar substrate surface at several intermediate stages during the fabrication of devices on a substrate assembly because non-uniform substrate surfaces significantly increase the difficulty of forming sub-micron features. For example, it is difficult to accurately focus photo patterns to within tolerances approaching 0.1 micron on non-uniform substrate surfaces because sub-micron photolithographic equipment generally has a very limited depth of field. Thus, CMP processes are often used to transform a topographical substrate surface into a highly uniform, planar substrate surface.

One conventional approach for improving the uniformity of the microelectronic substrate 12 is to engage the microelectronic substrate 12 with a planarizing pad 40 having a textured planarizing surface 42. For example, as shown in FIG. 2, the planarizing pad 40 can include spaced-apart texture elements 41. The texture elements 41 can improve the planarization of the microelectronic substrate 12 (FIG. 1) by retaining the planarizing liquid 44 (FIG. 1) in the interstices between the texture elements. Accordingly, the texture elements 41 increase the amount of planarizing liquid in contact with the microelectronic substrate 12 and increase the planarizing rate and surface uniformity of the microelectronic substrate 12.

One conventional method for forming the texture elements 41 is to engage a mold 50 with the planarizing pad 40 while the planarizing pad 40 is in a semi-solid or plastic state. For example, the mold 50 can include columnar apertures 51 that produce corresponding columnar texture elements 41 in the planarizing pad 40. One drawback with the foregoing fabrication method is that the mold 50 may deform the texture elements 41 as the mold 50 is withdrawn from the planarizing pad 40. For example, the planarizing pad material may adhere to the mold 50 or portions of the mold 50 such that the upper surfaces of the texture elements 41 develop sharp edges or other asperities 43. The asperities 43 can scratch or otherwise damage the microelectronic substrate 12 during planarization.

SUMMARY OF THE INVENTION

The present invention is directed toward methods and apparatuses for forming planarizing pads for planarizing microelectronic substrates. A method in accordance with one aspect of the invention includes separating a planarizing pad material into discrete elements and disposing the discrete elements on a support material. The discrete elements are disposed on the support material so that portions of the discrete elements are spaced apart from each other and project from the support material. The discrete elements are configured to engage the microelectronic substrate and to remove material from the microelectronic substrate when the microelectronic substrate contacts the discrete elements and at least one of the planarizing pad and the microelectronic substrate is moved relative to the other.

In one aspect of the invention, at least a portion of the planarizing pad material is in a liquid phase and separating the planarizing pad material includes forming discrete droplets of the planarizing pad material by mixing the planarizing pad material with a stream of gas. In another aspect of the invention, the discrete elements can be passed through apertures of a grate to control the distribution of the discrete elements on the support material. The discrete elements can be partially cured before they are disposed on the support material to partially solidify the discrete elements.

The invention is also directed toward a planarizing pad for planarizing a microelectronic substrate. In one aspect of the invention, the planarizing pad can include a support portion and a plurality of texture elements disposed on the support portion. Portions of the texture elements are spaced apart from each other and project from the support portion. The texture elements can have a generally smooth upper surface smoothly transitioning to a generally smooth side surface without asperities. In one aspect of the invention, the texture elements can have a cross-sectional dimension of from approximately 50 microns to approximately 200 microns. In another aspect of the invention, the texture elements can project from the support portion by a distance of from about 10 microns to about 200 microns.

The invention is also directed toward an apparatus for forming a planarizing pad. The apparatus can include a support device configured to hold a support material in a selected position, and can further include a vessel configured to contain a non-solid planarizing pad material. At least one nozzle is operatively coupled to the vessel and coupled to a source of compressed gas. The nozzle is configured to mix the planarizing pad material with the compressed gas to form discrete texture elements for disposing on the support material.

In one aspect of this invention, the support material is elongated in a longitudinal direction and the support device of the apparatus can include first and second rollers coupled to the support material and rotatable relative to each other to advance the support material from the first roller to the second roller. The apparatus can also include a hopper positioned between the nozzle and the support device. In another aspect of the invention, the apparatus can include two nozzles coupled to the vessel, the second nozzle being offset in the longitudinal direction and in a lateral direction transverse to the longitudinal direction relative to the first nozzle.

DETAILED DESCRIPTION

The present disclosure describes planarizing media and methods and apparatuses for forming planarizing media for chemical and/or chemical-mechanical planarizing of substrates and substrate assemblies used in the fabrication of microelectronic devices. Many specific details of certain embodiments of the invention are set forth in the following description and in FIGS. 3–6 to provide a thorough understanding of these embodiments. One skilled in the art, however, will understand that the present invention may have additional embodiments, or that the invention may be practiced without several of the details described below.

Figure 3:
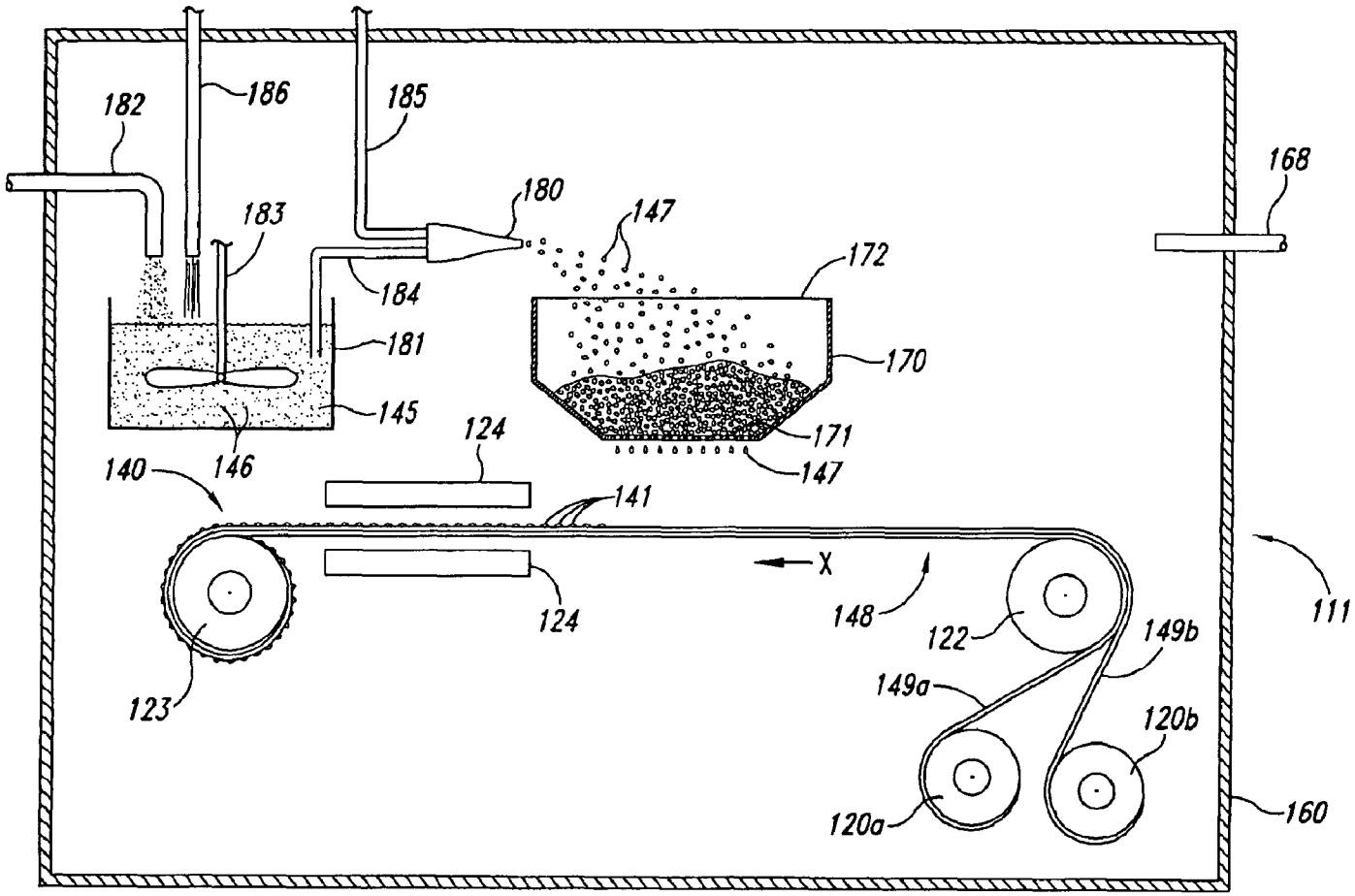
FIG. 3 is a partially schematic side elevational view of an apparatus for forming a planarizing pad in accordance with an embodiment of the invention.

FIG. 3 is a partially schematic side elevational view of an apparatus 111 for forming a planarizing pad 140 from a planarizing pad material 145 in accordance with an embodiment of the invention. The apparatus 111 can include a nozzle 180 that separates the planarizing pad material 145 into discrete particles 147. The particles 147 collect in a hopper 170 that distributes the particles 147 on a layer of support material 148 as the support material 148 passes below. The particles 147 bond to the support material 148 to form texture elements 141 on the planarizing pad 140, as will be discussed in greater detail below.

In one embodiment, the apparatus 111 can include an enclosure 160 that surrounds the nozzle 180, the hopper 170 and the planarizing pad 140. A gas supply conduit 168 can extend from a supply of gas (not shown) into the enclosure 160 to provide a temperature-controlled and/or conditioned gas to the enclosure 160. In a further aspect of this embodiment, the gas supply conduit 168 can provide an inert gas, such as helium or nitrogen, to the enclosure 160 to reduce the likelihood for contaminating the planarizing pad material 145 with foreign matter.

In one embodiment, the planarizing pad material 145 is provided in a mixing vessel 181. The planarizing pad material 145 can include a thermoset or thermoplastic material and/or a resin. One suitable pad material 145 is an acrylate in a liquid or gel state. A conduit 182 dispenses abrasive elements 146 (such as ceria or alumina particles) into the mixing vessel 181. The abrasive elements 146 can have a diameter of from about 50 nanometers to about 1500 nanometers. A stirrer 183 in the mixing vessel 181 mixes the abrasive elements 146 with the planarizing pad material 145 to uniformly distribute the abrasive elements 146 throughout the planarizing pad material 145.

The apparatus 111 can further include an additive conduit 186 for supplying one or more additives to the planarizing pad material 145. In one aspect of this embodiment, the additive can include a solvent for reducing the viscosity of the planarizing pad material 145. Accordingly, the planarizing pad material 145 can more easily separate into discrete particles. Alternatively, the additive can include other chemicals, such as oxidizers, surfactants, corrosion inhibitors and/or pH control agents, for controlling the rate and/or the manner that the planarizing pad 140 removes material from a microelectronic substrate (not shown) during planarization.

The apparatus 111 can further include a pad material conduit 184 that extends into the mixing vessel 181 and withdraws the mixture of the planarizing pad material 145 and the abrasive elements 146 from the vessel 181. The pad material conduit 184 is coupled to the nozzle 180 to provide a flow of the pad material mixture to the nozzle 180. The nozzle 180 is also coupled to a source of pressurized gas (not shown) by a gas conduit 185 to mix the gas with the pad material mixture. The nozzle 180 separates the pad material mixture into the pad material particles 147, each of which can include some of the abrasive elements 146.

In one embodiment, the pad material particles 147 are directed from the nozzle 180 into the hopper 170. Accordingly, the hopper 170 can include an opening 172 for receiving the pad material particles 147. In one aspect of this embodiment, the pad material particles 147 have a generally spherical or droplet-type shape immediately after exiting the nozzle 180. In a further aspect of this embodiment, the pad material particles 147 partially or completely solidify as they travel toward the hopper 170. For example, the distance between the nozzle 180 and the hopper 170 can be controlled to allow heat transfer from the pad material particles 147 sufficient to partially or completely solidify the particles. Accordingly, the pad material particles 147 do not agglomerate in the hopper 170.

The hopper 170 can include a grate or mesh 171 or another control element that controls the rate with which the pad material particles 147 exit through the bottom of the hopper 170. In one aspect of this embodiment, the grate 171 can include an array of apertures, each sized to pass a single pad material particle 147. Alternatively, the apertures of the grate 171 can be sized to pass multiple pad material particles 147. In either embodiment, the pad material particles 147 descend from the bottom of the hopper 170 to the support material 148 below.

The support material 148 can include an elongated backing sheet 149*a* of Mylar® or another suitable substrate. The support material 148 can also include an adhesive material 149*b* for bonding the pad material particles 147 to the support material 148. In one aspect of this embodiment, the backing sheet 149*a* is unwound from a first supply roller 120*a* and around a guide roller 122 to a take-up roller 123. The adhesive material 149*b* is unwound from a second supply roller 120*b* and around the guide roller 122 where the adhesive material 149*b* adheres to the backing sheet 149*a* to form the support material 148. The support material 148 proceeds as a unit to the take-up roller 123 as indicated by arrow "X."

As the support material 148 passes beneath the hopper 170, the pad material particles 147 descend from the hopper 170 and settle on the adhesive material 149*b* to form the planarizing pad 140. In one aspect of this embodiment, the adhesive material 149*b* cures and/or dries before the pad material particles 147 reach the take-up roller 123. Accordingly, the pad material particles 147 are permanently affixed to the support material 148 before the planarizing pad 140 rolls up on itself on the take-up roller 123. Alternatively, the apparatus 111 can include curing plates 124 positioned above and/or below the planarizing pad 140 for accelerating and/or otherwise controlling the curing process. In one aspect of this embodiment, the curing plates 124 include heating elements that elevate the temperature of the pad material elements 147, the adhesive material 149*b* and/or the backing sheet 149*a* until the pad material elements 147 are permanently affixed to the adhesive material 149*b*. In a further aspect of this embodiment, the curing plates 124 can also permanently affix the adhesive material 149*b* to the backing sheet 149*a*. The curing plates 124 can also include blowers, ultraviolet light or other radiation sources, and other suitable devices for curing and affixing the pad material elements 147 to the support material 148. In any of these foregoing embodiments, the pad material particles 147 become fixedly attached to the support material 148 in a manner suitable for mechanically and/or chemically-mechanically removing material from a microelectronic substrate in a manner similar to that discussed above.

Figure 1:
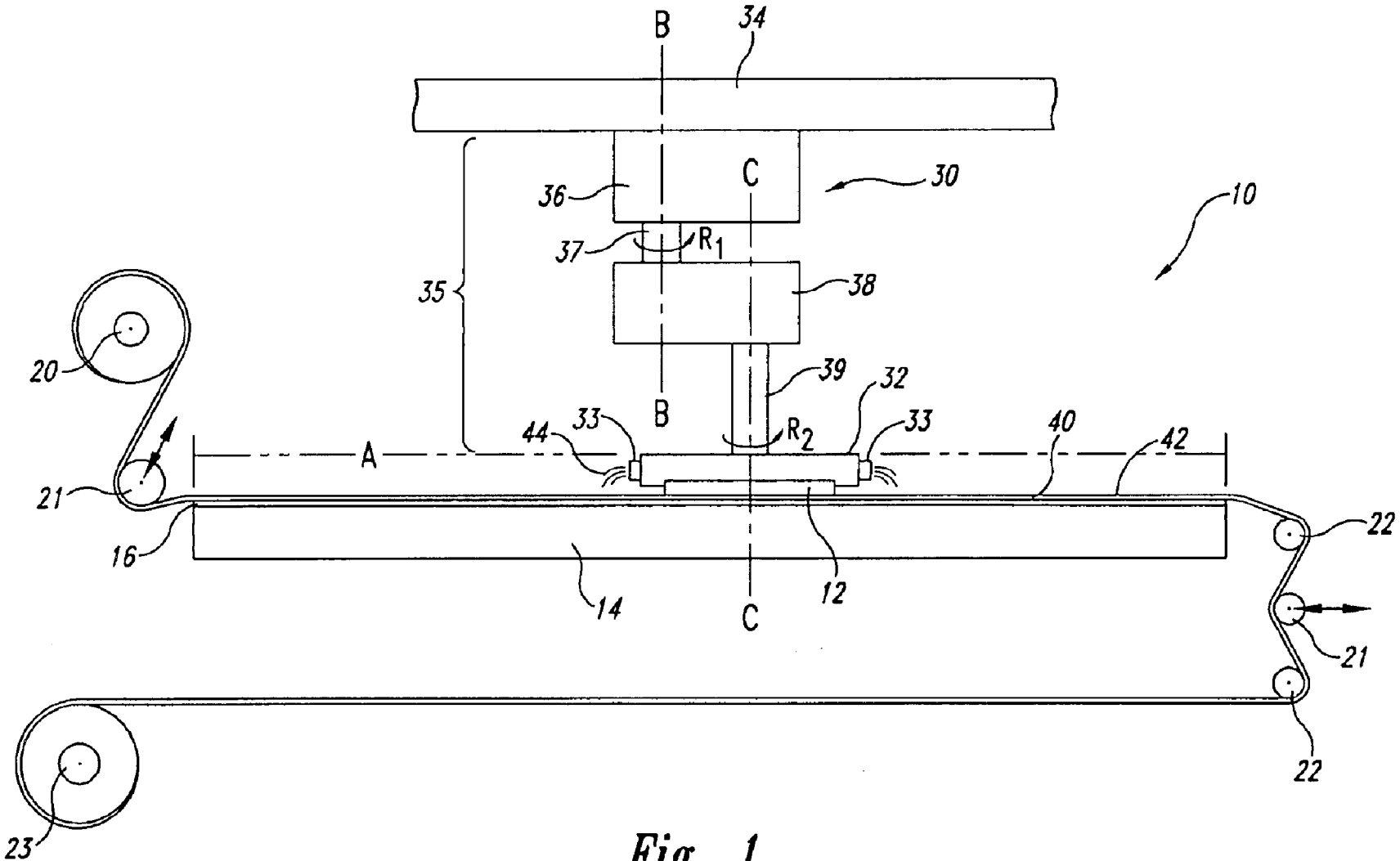
Fig. 1 (Prior Art)
FIG. 1 is a partially schematic side elevational view of a planarizing apparatus having a planarizing pad in accordance with the prior art.

In one aspect of the embodiment shown in FIG. 3, the pad material particles 147 descend from the hopper 170 in a continuous fashion, and the rate at which the planarizing pad 140 passes beneath the hopper 170 is controlled to produce a desired distribution of the pad material particles 147 on the planarizing pad 140. The distribution of the pad material particles 147, for example, can be uniform across the support material 148. Alternatively, the hopper 170 can include a gate (not shown) or another active device that mechanically and intermittently closes the lower surface of the hopper 170 to control the flow of pad material particles 147 to the planarizing pad 140. In either of these embodiments, the planarizing pad 140 can be installed on a web-format planarizing apparatus such as is shown in FIG. 1 during planarization. Alternatively, the planarizing pad 140 can be configured to operate on other types of planarizing machines, as will be discussed below with reference to FIG. 8.

Figure 4:
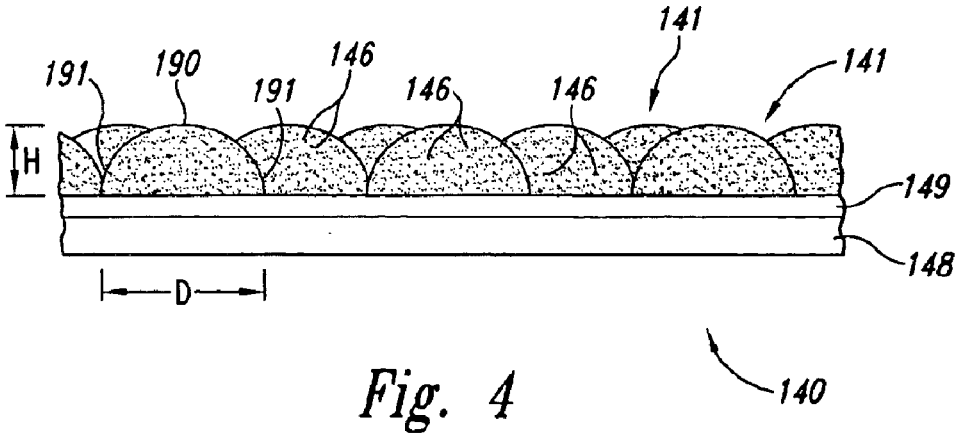
FIG. 4 is a detailed side elevational view of a portion of a planarizing pad formed with the apparatus shown in FIG. 3.

FIG. 4 is side elevational view of a portion of the planarizing pad 140 discussed above with reference to FIG. 3. The planarizing pad 140 includes a distribution of the pad material particles 147 (FIG. 3) that form the raised features 141. In one aspect of this embodiment, the raised features 141 can have a generally hemispherical shape. This shape can result because the initially spherical or droplet-shaped pad material particles 147 deform to the hemispherical shape when they strike the planarizing pad 140. Alternatively, the pad material particles 147 can retain their generally spherical or droplet shape and can become buried in the adhesive layer 149 so that the protruding top portions of the pad material particles 147 form the raised features 141. Alternatively, the raised features 141 can have shapes other than the hemispherical shapes shown in FIG. 4.

In any of these foregoing embodiments, the raised features 141 can have a cross-sectional dimension "D" of from approximately 50 microns to approximately 200 microns. The raised features 141 can project from the upper surface of the planarizing pad 140 by a distance "H" of from approximately 10 microns to approximately 200 microns. In still another aspect of this embodiment, the raised features 141 are sized and spaced such that the abrasive particles 146 contained in the raised features 141 cover from about 5% to about 50% of the upper surface of the planarizing pad 140. In a particular aspect of this embodiment, the raised features 141 are sized and spaced so that the abrasive elements 146 cover about 20% of the upper surface of the planarizing pad 140.

In one embodiment, each of the raised features 141 has an upper surface 190 that smoothly connects with side surfaces 191 to form a hemispherical surface, as was discussed above. Alternatively, the upper surface 190 together with the side surfaces 191 can form other generally smoothly contoured shapes. In either of these embodiments, the portion of the raised features 141 projecting above the upper surface of the planarizing pad 140 is generally smooth and does not have asperities or sharp edges. Accordingly, an advantage of an embodiment of the planarizing pad 140 discussed above with reference to FIGS. 3 and 4 is that it may be less likely to scratch or otherwise damage a microelectronic substrate during planarization.

Figure 2:
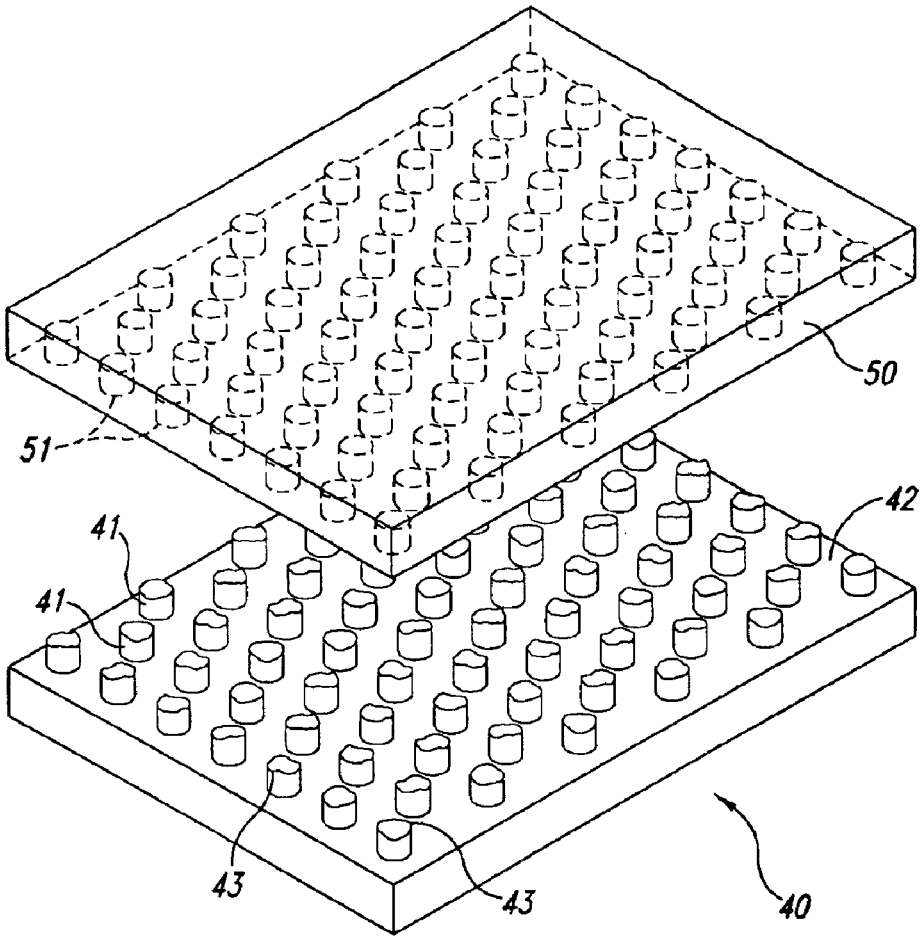
Fig. 2 (Prior Art)
FIG. 2 is a top isometric view of a portion of the planarizing pad shown in FIG. 1 and a mold used for forming the planarizing pad in accordance with the prior art.

Another feature of the method and apparatus for forming the planarizing pad 140 discussed above with reference to FIGS. 3 and 4 is that they are expected to provide good control of the abrasivity of the planarizing pad 140. For example, the spacing between the raised features 141 can be controlled by controlling the rate at which the hopper 170 discharges the pad material particles 147 to the planarizing pad 140 and/or the rate at which the planarizing pad 140 moves beneath the hopper 170. Controlling these process variables can be less expensive and less time consuming than providing and installing an individual mold for each different pattern of raised features, which may be required by the conventional technique discussed above with reference to FIG. 2.

Still another advantage of the methods and apparatuses discussed above with reference to FIGS. 3 and 4 is that they can improve the consistency of the resulting planarizing pad 140. For example, in conventional techniques that use molds to form raised features on the planarizing pad, surfaces of the mold can abrade, wear, or become contaminated (e.g., with residual polishing pad material). Each of these characteristics of the mold can reduce the consistency of the resulting planarizing pads. By contrast, an embodiment of the method and apparatus 111 discussed above eliminates the mold and accordingly can eliminate these drawbacks.

In an alternate embodiment, the apparatus 111 can include a plurality of mixing vessels 181 and/or hoppers 170, each of which contains pad material particles 147 having different abrasive elements 146 or a different concentration of abrasive elements 146. Accordingly, this embodiment of the apparatus 111 can produce a single planarizing pad 140 having regions with different types or concentrations of abrasive elements 146. Accordingly, the distribution of the raised features 141 over the planarizing pad 140 can vary over the surface of the planarizing pad 140. As a result, the planarizing pad 140 may be particularly suitable for planarizing different portions of a microelectronic substrate at different rates, and may be difficult to form using the conventional mold technique discussed above with reference to FIG. 2.

Figure 5:
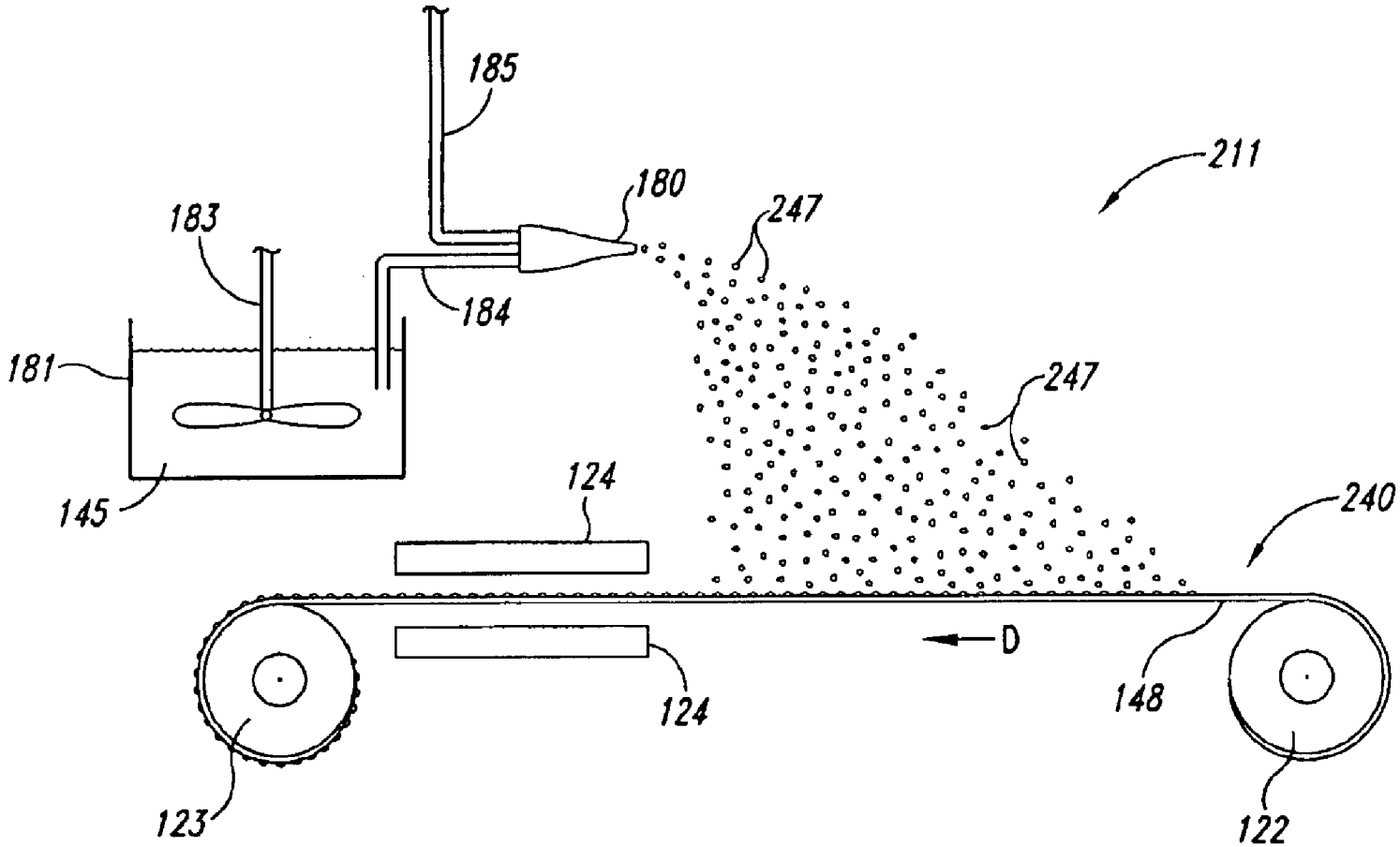
FIG. 5 is a partially schematic side elevational view of an apparatus for forming planarizing pads in accordance with another embodiment of the invention.

FIG. 5 is a partially schematic, side elevational view of an apparatus 211 for forming a planarizing pad 240 in accordance with another embodiment of the invention. In one aspect of this embodiment, the planarizing pad material 145 is mixed in the mixing vessel 181 without adding abrasive elements. Accordingly, the resulting planarizing pad 240 can be used with slurries or other planarizing liquids having a suspension of abrasive elements.

In another aspect of the embodiment shown in FIG. 5, a plurality of pad material particles 247 are distributed directly from the nozzle 180 to support material 148 without first collecting in a hopper (as was discussed above with reference to FIG. 3). Accordingly, the pad material particles 247 need not solidify (or need not solidify to the same degree as the pad material particles 147 discussed above with reference to FIG. 3) before impinging on the support material 148. In a further aspect of this embodiment, the pad material elements 247 form a random distribution of raised elements 241 on the support material 148. Alternatively, the distribution of the pad material particles 247 can be controlled or partially controlled by inserting a grate or other flow control device between the exit of the nozzle 180 and the planarizing pad 240.

In still another aspect of the embodiment shown in FIG. 5, the support material 148 does not include an adhesive layer 149*b* (FIG. 3). Instead, the pad material particles 247 descend directly onto the support material 148. In a particular aspect of this embodiment, the support material 148 can have the same chemical composition as the pad material particles 247, and can include an uncured or partially cured material, such as an acrylate or acrylic resin. The pad material particles 247 can be cured along with the support material 148 when the planarizing pad 240 passes through the curing plates 124. This process both solidifies the pad material particles 247 and bonds the particles 247 to the support material 148.

In yet another aspect of the embodiment shown in FIG. 5, the nozzle 180 can be directed at least partially downwardly toward the support material 148, so that the pad material particles 247 have an increased downward velocity as they strike the support material 148. Accordingly, the nozzle 180 can embed the pad material particles 247 in the support material 148. This technique can also be used when the support material 148 supports an adhesive material to embed the pad material particles 247 in the adhesive material.

Figure 6:
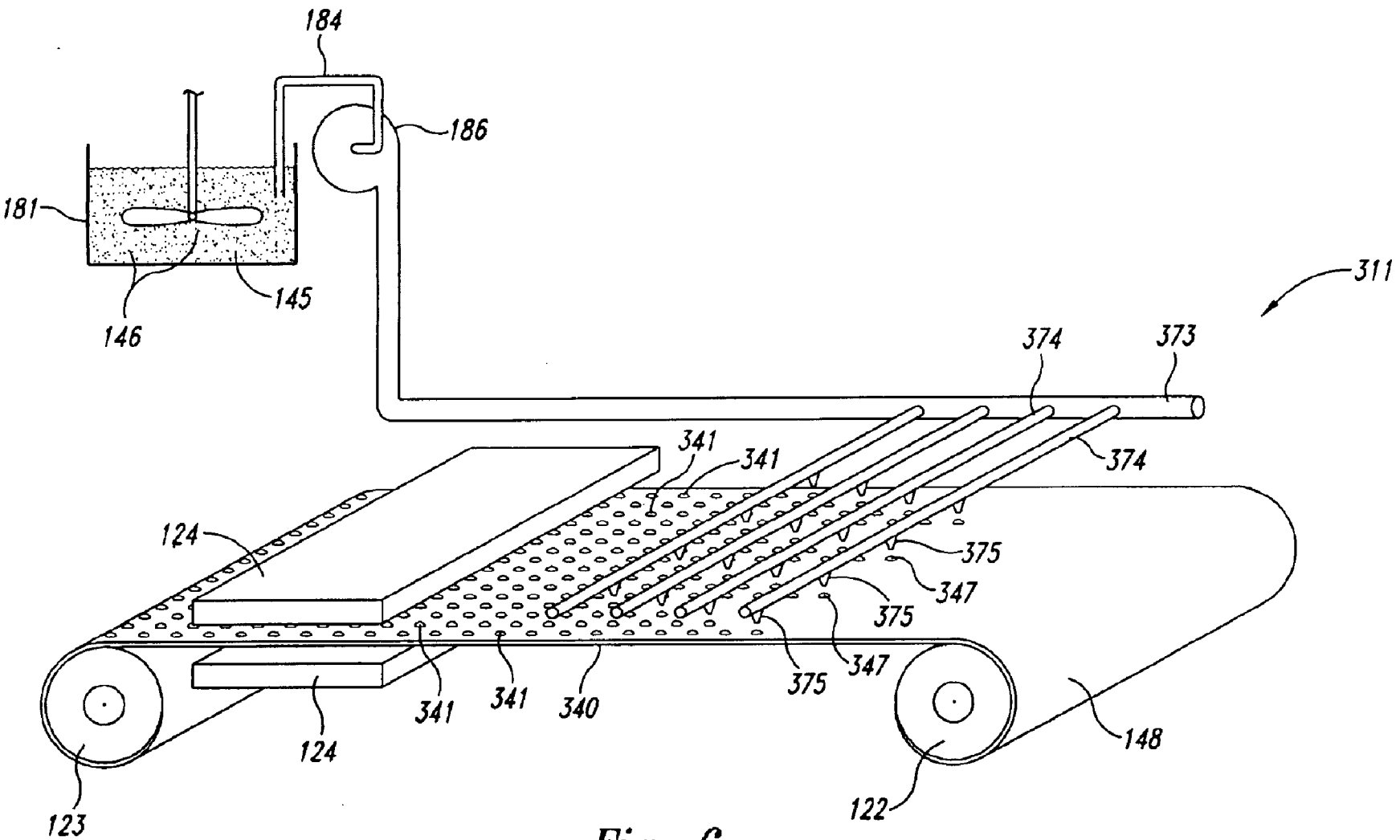
FIG. 6 is a partially schematic top isometric view of an apparatus for forming a planarizing pad in accordance with yet another embodiment of the invention.

FIG. 6 is a partially schematic top isometric view of an apparatus 311 for forming a polishing pad 340 having a highly controlled distribution of raised features 341 in accordance with yet another embodiment of the invention. In one aspect of this embodiment, the planarizing pad material 145 is withdrawn from the mixing vessel 181 into the pad material conduit 184. In the embodiment shown in FIG. 6, the planarizing pad material 145 includes abrasive elements 146; alternatively, abrasive elements can be disposed in a slurry in a manner similar to that discussed above with reference to FIG. 5. In either embodiment, the pad material conduit 184 is coupled to a pump 186 that pumps the planarizing pad material 145 to a manifold 373 positioned proximate to the support material 148. The manifold 373 is coupled to a plurality of spray bars 374 that extend transversely over the surface of the support material 148. Each spray bar 374 includes a plurality of spray bar nozzles 375 directed downwardly or at least partially downwardly toward the support material 148. The planarizing pad material 145 exits the spray bar nozzles 375 to form discrete pad material particles 347 that impinge on the support material 148 and form the raised features 341.

In one aspect of the embodiment shown in FIG. 6, the spray bar nozzles 375 of adjacent spray bars 374 are offset laterally from each other to produce a staggered arrangement of raised elements 341. The lateral spacing of the raised elements 341 can be controlled by selecting the spacing between adjacent spray bar nozzles 375 on each spray bar 374 and by selecting the total number of spray bars 374 positioned over the support material 148. The spacing of the raised elements 341 in the longitudinal direction can be controlled by the rate at which the polishing pad material 145 is pumped through the spray bar nozzles 375, and the rate at which the support material 148 is advanced from the supply roller 122 to the take-up roller 123.

In another aspect of the embodiment shown in FIG. 6, the pad material particles 347 can be fixedly bonded to the support material 148 when the support material 148 passes between the curing plates 124. Alternatively, the pad material particles can bond to the support material 148 without the curing plates 124 and the curing plates 124 can be eliminated. In another alternative arrangement, the support material 148 can support an adhesive material 149 (FIG. 3) and the pad material elements 347 can bond to the adhesive material 149, with or without curing.

Figure 7:
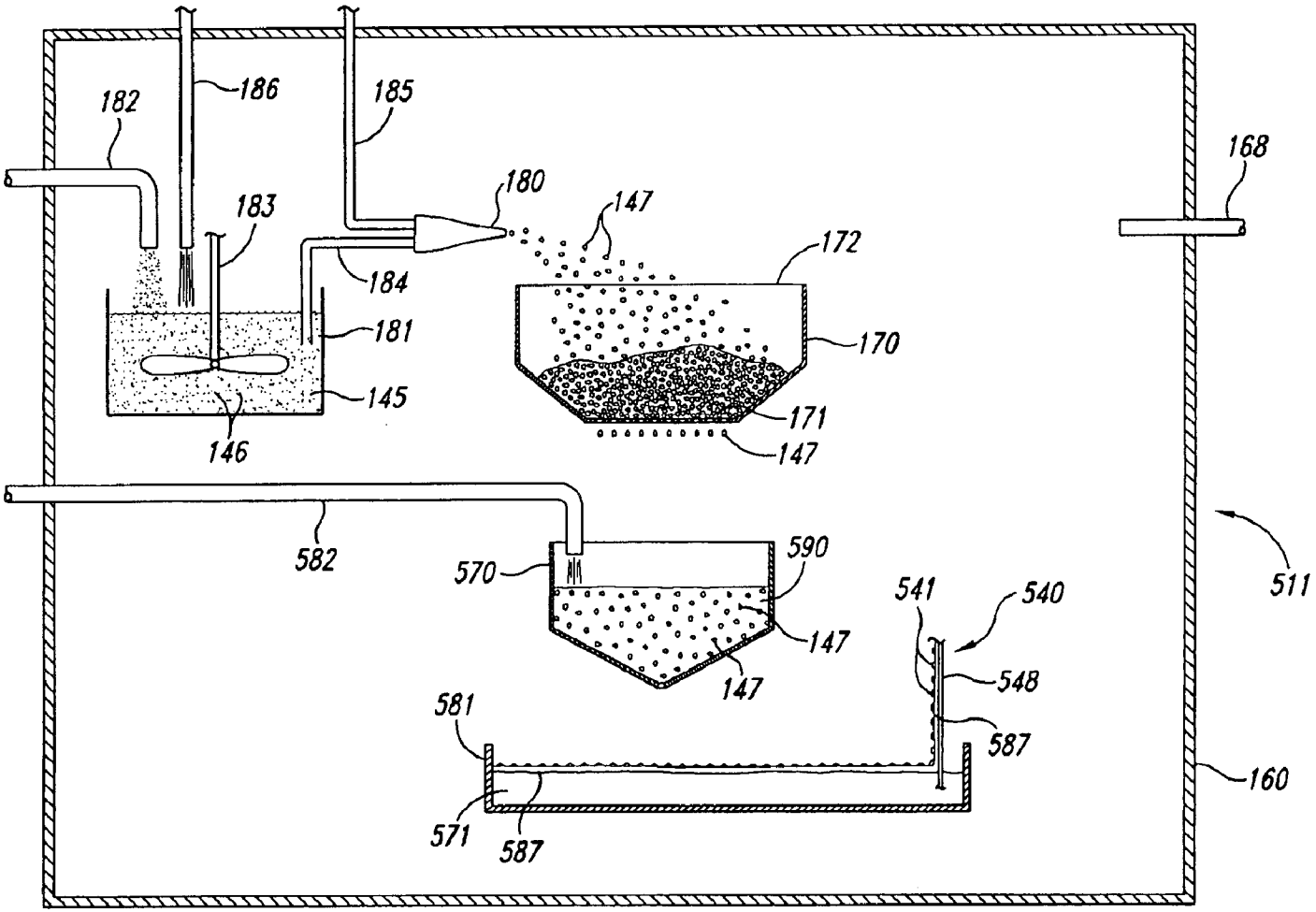
FIG. 7 is a partially schematic side elevational view of an apparatus for forming a planarizing pad with a liquid-borne film in accordance with still another embodiment of the invention.

FIG. 7 is a partially schematic side elevational view of an apparatus 511 for forming a planarizing pad 540 using a liquid-borne film in accordance with another embodiment of the invention. The apparatus 511 can include a mixing vessel 181 and a hopper 170 configured to produce pad material particles 147 in a manner generally similar to that discussed above with reference to FIG. 3. In one aspect of this embodiment, the pad material particles 147 collect in a film vessel 570 where they mix with a liquid film material 590 supplied by a film material conduit 582. The film material 590 and the pad material particles 147 are then disposed on a support liquid 571 contained in a support liquid vessel 581 to form a film 587 that floats on the support liquid 571. Accordingly, the support liquid 571 can include a liquid (such as water) that has a specific gravity greater than the specific gravity of the film material 590.

In a further aspect of this embodiment, the film 587 can be one molecule thick (i.e., a monolayer or Langmuir-Blodgett film) with the pad material particles 147 either resting on the surface of the monolayer or partially embedded in the monolayer. Accordingly, the film material 590 can include any organic material that forms a monolayer or Langmuir-Blodgett film. The apparatus 511 can include a moveable barrier (not shown) that pushes the film 587 together until a dense monomolecular film is formed on the surface of the support liquid 571. Alternatively, the film material 590 can be selected to form a film 587 having a thickness of more than one molecule. An advantage of the one-molecule-thick monolayer is that it has a uniform thickness and may accordingly form a more uniform planarizing pad.

In either of the above embodiments, the film 587 is removed from the support liquid vessel 581 by disposing a support or backing material 548 (such as Mylar®) in the support liquid vessel 581 and drawing the backing material 548 away from the support liquid vessel 581 with the film 587 attached. In one aspect of this embodiment the backing material 548 can be supported on rollers generally similar to those described above with reference to FIG. 6. The composite of the backing material 548, the film 587, and the pad material particles 147 form a planarizing pad 540 having texture elements 541. In another aspect of this embodiment, an adhesive can be sprayed over the planarizing pad 540 to more securely attach the film 587 to the backing material 548. Alternatively, the film 587 can be heat cured to the backing material 548.

In another alternate embodiment, the film vessel 570 can be eliminated and the film material conduit 582 (or another delivery device) can dispose the film material 590 directly onto the support liquid 571 in the support material vessel 581. The pad material particles 147 can be disposed directly from the hopper 170 onto the film 587. In still another alternate arrangement, the nozzle 180 can direct the pad material particles 147 directly onto the film 587 without the hopper 170, in a manner generally similar to that discussed above with reference to FIG. 5.

Figure 8:
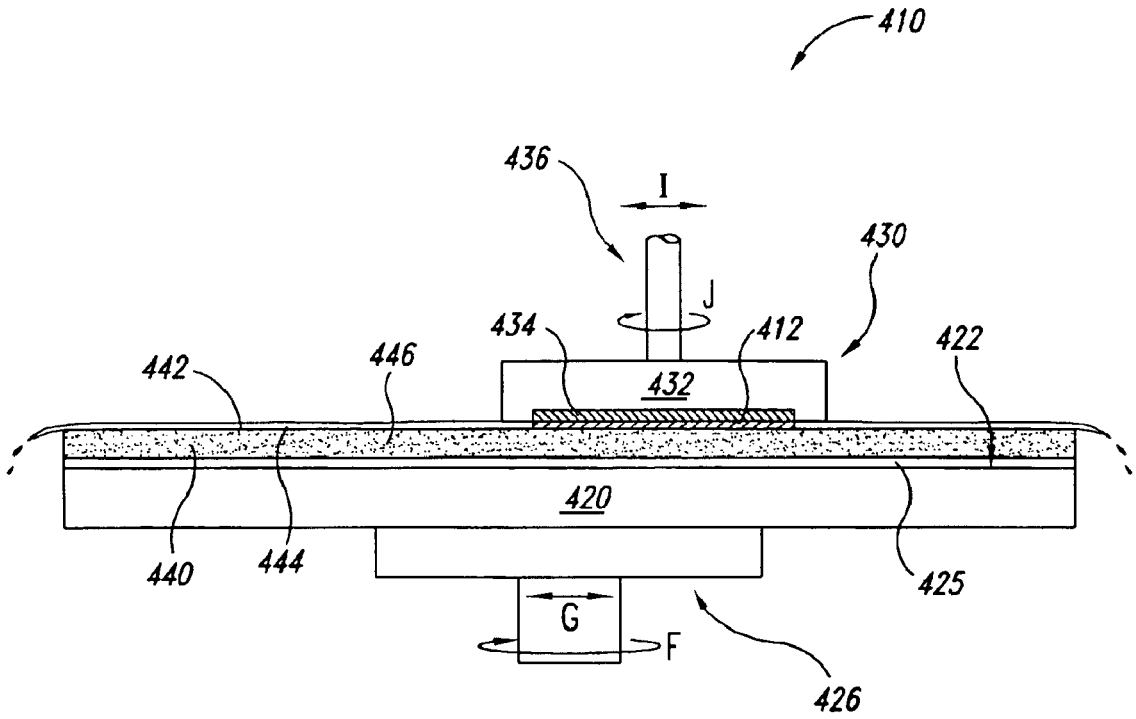
FIG. 8 is a partially schematic side elevational view of a CMP machine that supports a polishing pad in accordance with another embodiment of the invention.

FIG. 8 is a partially schematic cross-sectional view of a rotary planarizing machine 410 with a generally circular platen or table 420, a carrier assembly 430, a planarizing pad 440 positioned on the table 420, and a planarizing liquid 444 on the planarizing pad 440. The composition and construction of the planarizing pad 440 can be generally similar to any of the compositions and constructions of the planarizing pads discussed above with reference to FIGS. 3–7, except that the planarizing pad 440 has a generally circular planform shape corresponding to the shape of the table 420.

In one aspect of this embodiment, the planarizing liquid 444 can be a slurry having a suspension of abrasive elements, and the planarizing pad 440 can have no abrasive elements. Alternatively, the planarizing pad 440 can have abrasive elements 446 and the planarizing liquid 444 can have no abrasive elements. In either embodiment, the planarizing machine 410 may also have an under-pad 425 attached to an upper surface 422 of the platen 420 for supporting the planarizing pad 440. A drive assembly 426 rotates (arrow "F") and/or reciprocates (arrow "G") the platen 420 to move the planarizing pad 440 during planarization.

The carrier assembly 430 controls and protects a microelectronic substrate 412 during planarization. The carrier assembly 430 typically has a substrate holder 432 with a pad 434 that holds the microelectronic substrate 412 via suction. A drive assembly 436 of the carrier assembly 430 typically rotates and/or translates the substrate holder 432 (arrows "J" and "I," respectively). Alternatively, the substrate holder 432 may include a weighted, free-floating disk (not shown) that slides over the planarizing pad 440. To planarize the microelectronic substrate 412 with the planarizing machine 410, the carrier assembly 430 presses the microelectronic substrate 412 against a planarizing surface 442 of the planarizing pad 440. The platen 420 and/or the substrate holder 432 then move relative to one another to translate the microelectronic substrate 412 across the planarizing surface 442. As a result, the abrasive particles in the planarizing pad 440 and/or the chemicals in the planarizing liquid 444 remove material from the surface of the microelectronic substrate 412.

From the foregoing, it will be appreciated, that although specific embodiments of the invention have been described herein for purposes of illustration, various modifications may be made without deviating from the spirit and scope of the invention. For example, the apparatuses shown in FIGS. 5 and 6 can include an enclosure similar to the one shown in FIG. 3. Accordingly, the invention is not limited except as by the appended claims.

What is claimed is:

1. A planarizing pad for planarizing a microelectronic substrate, comprising:

a generally planar support portion; and a plurality of texture elements disposed on the support portion, portions of the texture elements being spaced apart from each other and projecting from the support portion, the individual texture elements having a generally smooth upper surface, smoothly transitioning to a generally smooth side surface without asperities, wherein the texture elements have a first spacing in a first region of the support portion and a second spacing in a second region of the support material with the first spacing different than the second spacing.

2. The planarizing pad of claim 1 wherein the texture elements have a plurality of abrasive particles embedded therein.

3. The planarizing pad of claim 1 wherein the texture elements include partially spherical droplets.

4. The planarizing pad of claim 1 wherein the texture elements have a cross-sectional dimension of from approximately 50 microns to approximately 200 microns.

5. The apparatus of claim 1 wherein the texture elements project from the support portion by a distance of from about 10 microns to about 200 microns.

6. The planarizing pad of the claim 1 wherein the support portion is elongated in a longitudinal direction.

7. The planarizing pad of claim 1 wherein the support portion has a generally circular shape.

8. The planarizing pad of claim 1 wherein the support portion includes a support material, further comprising an adhesive material between the support material and the texture elements.

9. The planarizing pad of claim 1, further comprising a selected chemical agent embedded in the texture elements.

10. The planarizing pad of claim 9 wherein the selected chemical agent includes at least one of a surfactant and an oxidizer.

11. The planarizing pad of claim 1 wherein the texture elements and the support portion have the same chemical composition.

12. A planarizing pad for planarizing a microelectronic substrate, comprising:

a support portion; and a plurality of discrete texture elements disposed on the support portion, the texture elements being initially separate from the support portion and subsequently bonded to the support portion with portions of the texture elements being spaced apart from each other and projecting from the support portion, the individual texture elements having a generally smooth upper surface, wherein the texture elements have a first spacing in a first region of the support portion and a second spacing in a second region of the support portion with the first spacing different than the second spacing.

13. The planarizing pad of claim 12 wherein the texture elements have a plurality of abrasive particles embedded therein.

14. The planarizing pad of claim 12 wherein the texture elements include partially spherical droplets.

15. The planarizing pad of claim 12 wherein the texture elements have a cross-sectional dimension of from approximately 50 microns to approximately 200 microns.

16. The planarizing pad of claim 12 wherein the texture elements project from the surface of the support material by a distance of from about 10 microns to about 200 microns.

17. The planarizing pad of claim 12 wherein the support portion includes a support material, further comprising an adhesive material between the support material and the texture elements.

18. The planarizing pad of claim 12, further comprising a selected chemical agent embedded in the texture elements.

19. The planarizing pad of claim 12 wherein the texture elements and the support portion have the same chemical composition.

20. A planarizing pad for planarizing a microelectronic substrate, comprising:

a generally planar support portion having a surface; and a plurality of texture elements disposed on the surface of the support portion, portions of the individual texture elements being spaced apart from each other and projecting from the support portion, the individual texture elements having a generally smooth upper surface, smoothly transitioning to a generally smooth side surface without asperities, wherein the texture elements cover less than 20 percent of the surface of the support portion, and wherein the individual texture elements have a cross-sectional dimension of from approximately 50 microns to 100 microns.

* * * * *